United States Patent [19]

Wingate

[11] 4,448,328

[45] May 15, 1984

[54] MACHINE FOR VENDING ARTICLES SUCH AS NEWSPAPERS, MAGAZINES AND THE LIKE

[75] Inventor: W. Jack Wingate, Charlotte, N.C.

[73] Assignee: Hennessy Products, Incorporated, Chambersburg, Pa.

[21] Appl. No.: 343,157

[22] Filed: Jan. 27, 1982

[51] Int. Cl.[3] ..... G07F 11/28

[52] U.S. Cl. ..... 221/13; 221/6; 221/17; 221/22; 221/151; 221/195; 221/251; 221/289

[58] Field of Search ..... 221/2, 4, 6, 17, 22, 221/151, 155, 190, 191, 194, 195, 251, 258, 289, 9, 13

[56] References Cited

U.S. PATENT DOCUMENTS

| | | | |
|---|---|---|---|
| 388,369 | 8/1888 | Morse et al. | 221/289 X |
| 2,546,352 | 3/1951 | Weaver | 221/17 |
| 2,550,884 | 5/1951 | Tandler | 221/13 |
| 2,564,552 | 8/1951 | Verdery, Jr. | 221/13 X |
| 3,064,856 | 11/1962 | Council | 221/13 |
| 4,312,461 | 1/1982 | Godley, Sr. | 221/195 |
| 4,365,701 | 12/1982 | Armstrong et al. | 221/289 X |

*Primary Examiner*—Joseph J. Rolla
*Assistant Examiner*—Kevin P. Shaver
*Attorney, Agent, or Firm*—F. Travers Burgess

[57] ABSTRACT

A machine for vending flat articles such as newspapers, magazines and the like comprises an enclosed cabinet having a merchandise storage magazine with an inclined bottom wall and an inclined outlet chute substantially aligned with the magazine bottom wall and having a discharge opening communicating with the exterior of the cabinet, an upright vertically movable bar between the storage magazine and the outlet chute, power actuated means for lowering the bar to release individual articles from the magazine and permit them to slide over the bar onto the outlet chute, coin actuated means for energizing the power means, and means responsive to movement of a released article across the top of the bar for de-energizing the power means and interrupting downward movement of the bar after each article has passed from the magazine onto the outlet chute.

11 Claims, 9 Drawing Figures

MACHINE FOR VENDING ARTICLES SUCH AS NEWSPAPERS, MAGAZINES AND THE LIKE

BACKGROUND OF THE INVENTION

1. Field of the Invention

The invention relates to coin controlled merchandise dispensing apparatus and consists particularly in a coin operated machine for vending flat articles such as newspapers, magazines and the like.

2. The Prior Art

The closest approach in the prior art to the present invention is G. D. Morse et al U.S. Pat. No. 388,369, in which newspapers are supported in a cabinet on a forwardly and downwardly sloping surface and prevented from sliding thereoff by a vertically movable bar having a beveled upper end to facilitate a newspaper sliding over it when it is moved downwardly the thickness of a newspaper. The bar is movable downwardly by completely mechanical means initiated by the insertion of the proper coin into a chute through which it drops into a pan causing the latter to rotate a shaft which causes a pawl to disengage from a ratchet on a second shaft mounting a pinion engaging a rack on the bar, thus permitting the second shaft to rotate freely and allow the bar to be pulled downwardly by a pair of coil springs. As the top newspaper is freed by lowering movement of the bar it slides across the beveled top of the bar toward the delivery slot, the newspaper strikes a pair of rods which rotate a third shaft causing the pawl to engage the ratchet, thereby stopping rotation of the second, pinion mounting, shaft and halting downward movement of the bar as soon as the top paper on the stack has been released.

SUMMARY OF THE INVENTION

The invention provides a machine for vending newspapers, magazines and the like in which the customer is restricted to a single copy in response to the insertion into the machine of sufficient coinage to cover the price of a single copy. The machine is constructed to prevent dishonest persons from paying for one copy and extracting additional copies from the machine as frequently occurs with conventional newspaper vending apparatus, in which the customer has ready access to the entire stock of newspapers in the machine when he inserts sufficient coins to obtain a single copy.

The machine is constructed to permit fast and easy bulk loading and provides automatic accommodation to variances or thickness of the newspapers. It is suitable for outdoor and indoor locations and can be operated by any combination of nickels, dimes and quarters aggregating the full price of the individual newspapers.

The invention also provides a machine for vending newspapers, magazines and the like in which the only action required from the customer is the insertion of the proper coins, which results in the automatic dispensing of the newspapers. There are no levers to pull, handles to push or cranks to turn. The coin slot and the newspaper delivery chute outlet are conveniently located to permit operation of the machine easily from a standing position or from a wheelchair.

The machine is constructed so that after all newspapers in the magazine portion of the machine have been dispensed, a newspaper in a window in the front of the machine is dispensed, exposing a "SOLD OUT" sign, to make prospective customers aware of this condition.

DETAILED DESCRIPTION OF THE INVENTION

Figure 3:
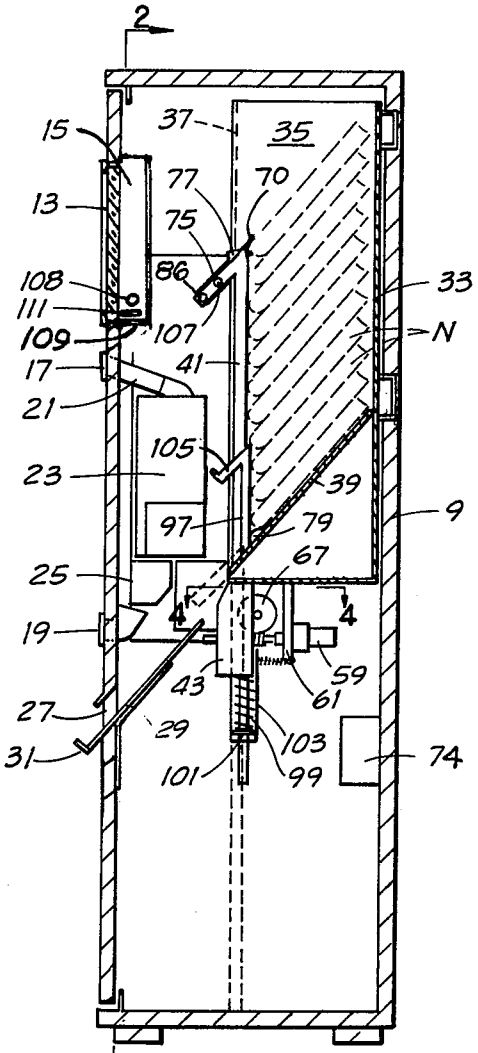
FIG. 3 is a vertical sectional view taken along line 3—3 of FIG. 2.
Figure 2:
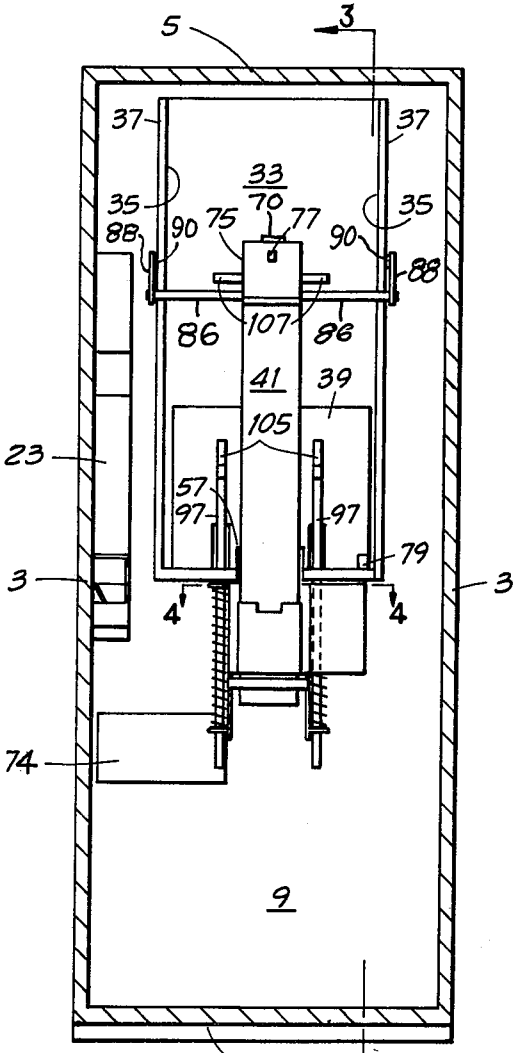
FIG. 2 is a transverse sectional view taken along line 2—2 of FIG. 3.
Figure 1:
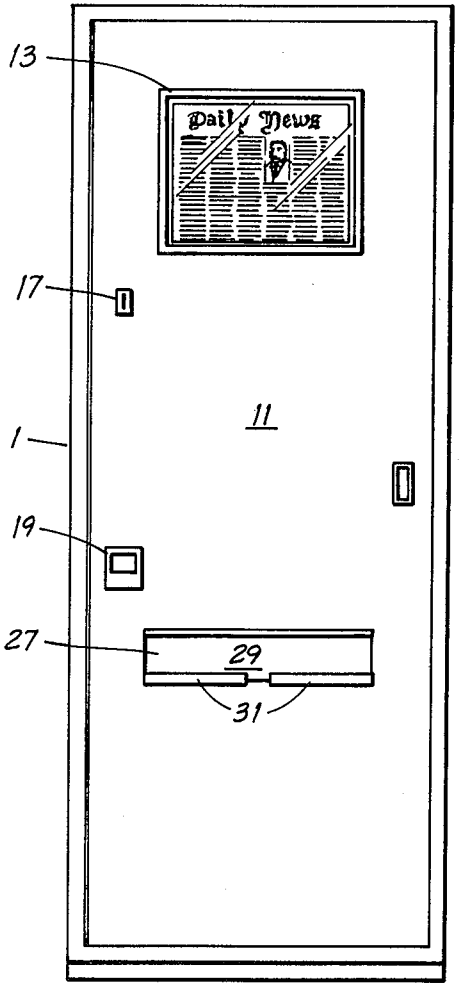
FIG. 1 is a front elevation of a vending machine constructed in accordance with the invention.
Figure 4:
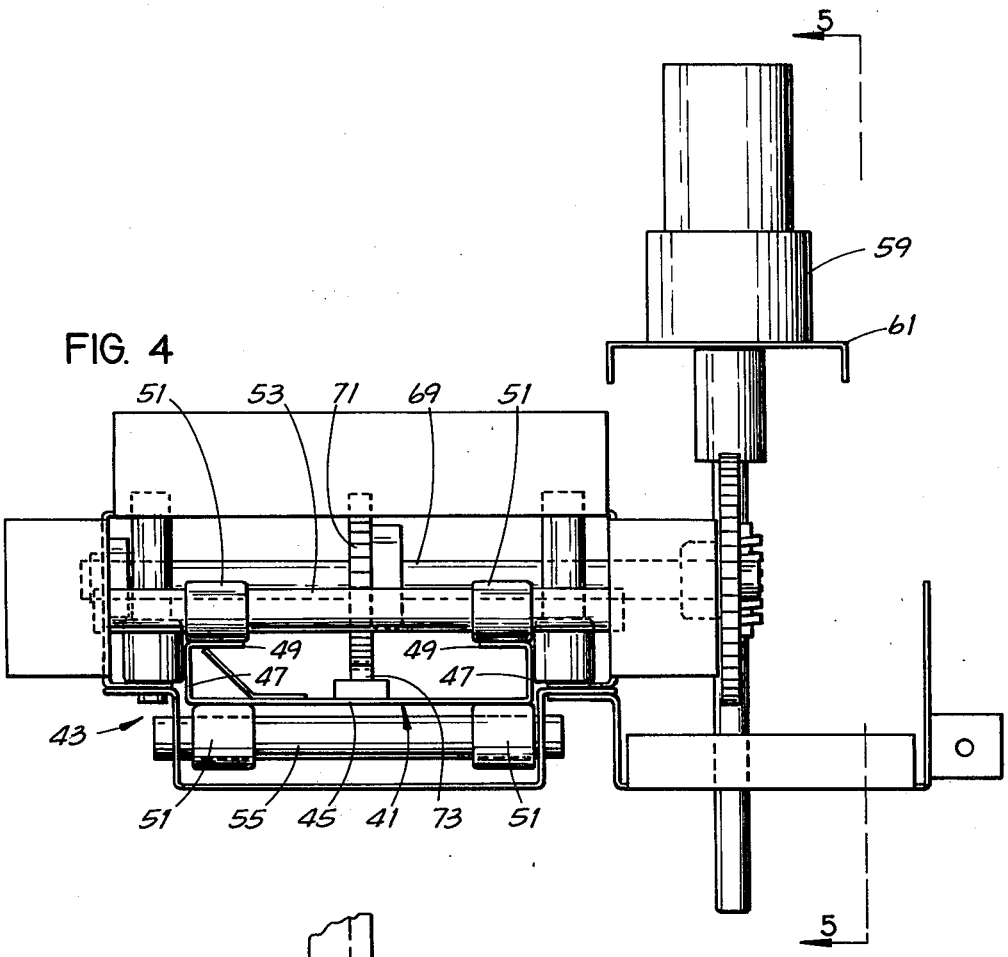
FIG. 4 is an enlarged horizontal sectional view taken along lines 4—4 of FIGS. 2 and 3 showing the top of the drive mechanism.

The numeral 1 denotes an upright rectangular cabinet having side walls 3, top and bottom walls 5 and 7, rear wall 9 and removable front wall or cover 11. Front wall 9 has a rectangular display window 13 in its upper portion behind which is a shallow upwardly open chamber 15 for the insertion of a display newspaper. Near the left margin of the door 11 and slightly below display window 13 is a coin slot 17 and directly below it is a coin return pocket 19. Coin slot 17 has a chute 21 which communicates with a coin controlled command module assembly 23 mounted on the left side wall 3 of cabinet 1 immediately below coin chute 21 and inwardly of door 11. At its lower end command module panel 23 has a coin outlet chute 25 which discharges into coin return pocket 19.

Door 11 also is provided with a transverse elongated newspaper delivery aperture 27 through which newspaper delivery chute 29 projects and terminates in an upturned lip 31 at its outer end to prevent discharged newspapers from dropping to the ground. A storage magazine for stocking the newspapers has a rear wall 33 secured to cabinet rear wall 9, side walls 35 formed with outturned flanges 37 along their forward edges and a sloping bottom wall 39 having the same slope as delivery chute 29 and being at a slightly higher level than the latter. The front and top of the magazine are open.

For retaining newspapers N in the magazine and selectively discharging them responsive to insertion of the proper coins in coin slot 17, an upright post 41 is vertically movably mounted in a housing 43 secured to the bottom of a magazine adjacent the forward or lower edge of sloping bottom wall 39. Post 41 is of channel section having a forwardly facing web 45, flanges 47 with inwardly bent terminals 49, and it is positioned in housing 43 by rollers 51 mounted on vertically spaced pairs of shafts 53 and 55, which are journaled in housing 43 parallel to post web 45 and flanged terminals 49 which engage rollers 51.

From the foregoing it will be seen that post 41 is vertically movable relative to the bottom wall 39 of the magazine and bottom wall 39 being cut-away along its forward margin at 57 to permit the passage therethrough of post 41. For producing vertical movement of post 41, an electric motor 59 is mounted on a bracket 61 depending from the bottom of the magazine with motor shaft 63 extending therefrom and mounting worm 65 which meshes with a gear 67 secured to the end of a shaft 69, which extends through the housing 43 and mounts a pinion 71 which engages a rack 73 mounted within post 41 on the rear surface of its web 45 such that when motor 59 is energized, it will cause rotation of shaft 69 and of pinion 71 to produce vertical movement of post 41. Energy to operate motor 59 is provided by battery 72 mounted in a suitable box 74 on the rear wall 9 of the cabinet, which is connected by a conductor 76 to a normally open switch 68 closable by the insertion of the proper coins in command module 23.

Post 41 has a forwardly extending inclined upper end portion 75 with the same slope as magazine bottom wall 39, which is recessed to permit the top of post end portion 75 to be flush with the magazine bottom wall when fully lowered. To prevent newspapers in the magazine bearing against the rear of post 41 and cocking it with respect to its guide rollers 51, with resultant resistance to its vertical movement, the lower or forward end of post end portion 75 mounts a transverse rod 86 to the ends of which are rigidly secured rearwardly extending idler arms 88, on the rear ends of which are mounted rollers 90 engaging the rear surfaces of magazine side wall flanges 37. An upwardly and rearwardly extending tab 70, approximately ¼ inch long and inclined at approximately 8° from the vertical is formed at the rear or upper edge of sloping end 75 on post 41 to bear slightly downwardly against the leading margin of the uppermost nuewpaper in the magazine and thereby provide precise control of the release of newspapers by positively separating the top of the topmost newspaper behind the post from the bottom of the preceding released newspaper.

Figure 5:
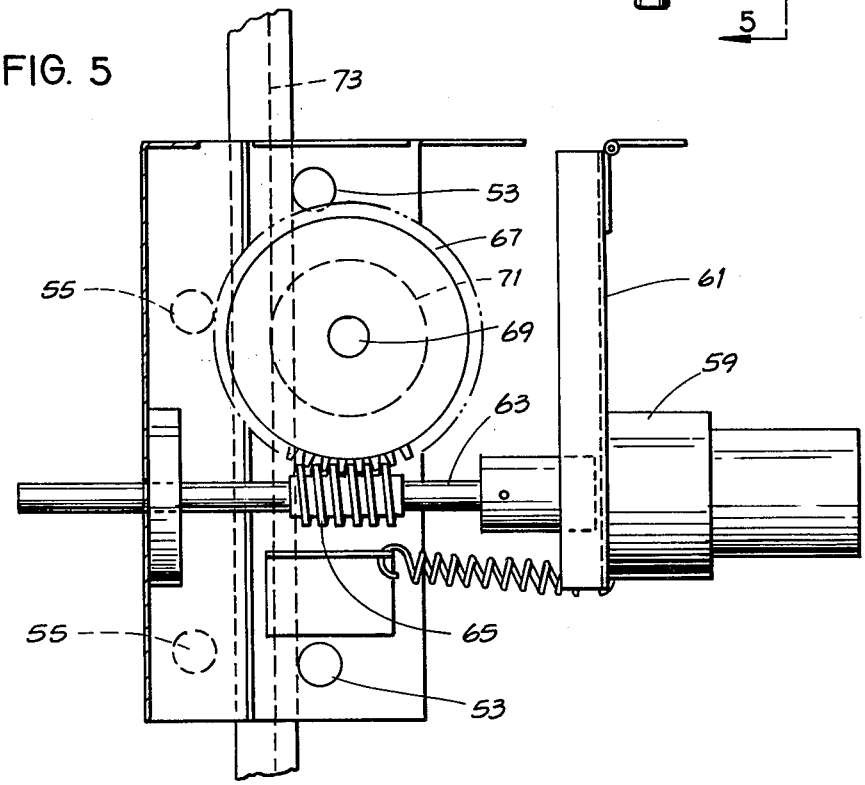
FIG. 5 is an enlarged side elevational view of the drive mechanism shown in FIG. 4.
Figure 6:
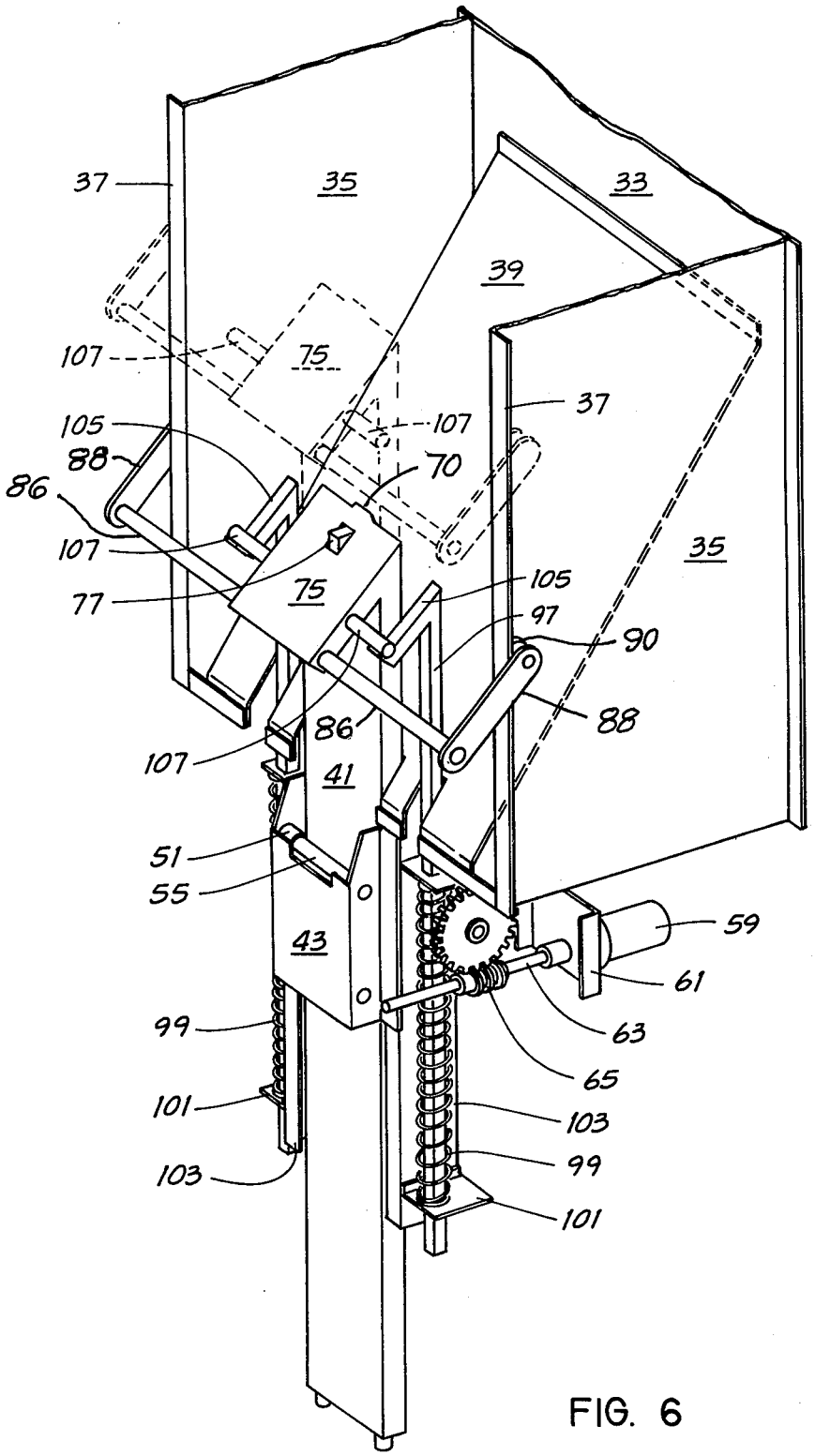
FIG. 6 is an isometric view showing the lower portion of the magazine and the operating mechanism.
Figure 7:
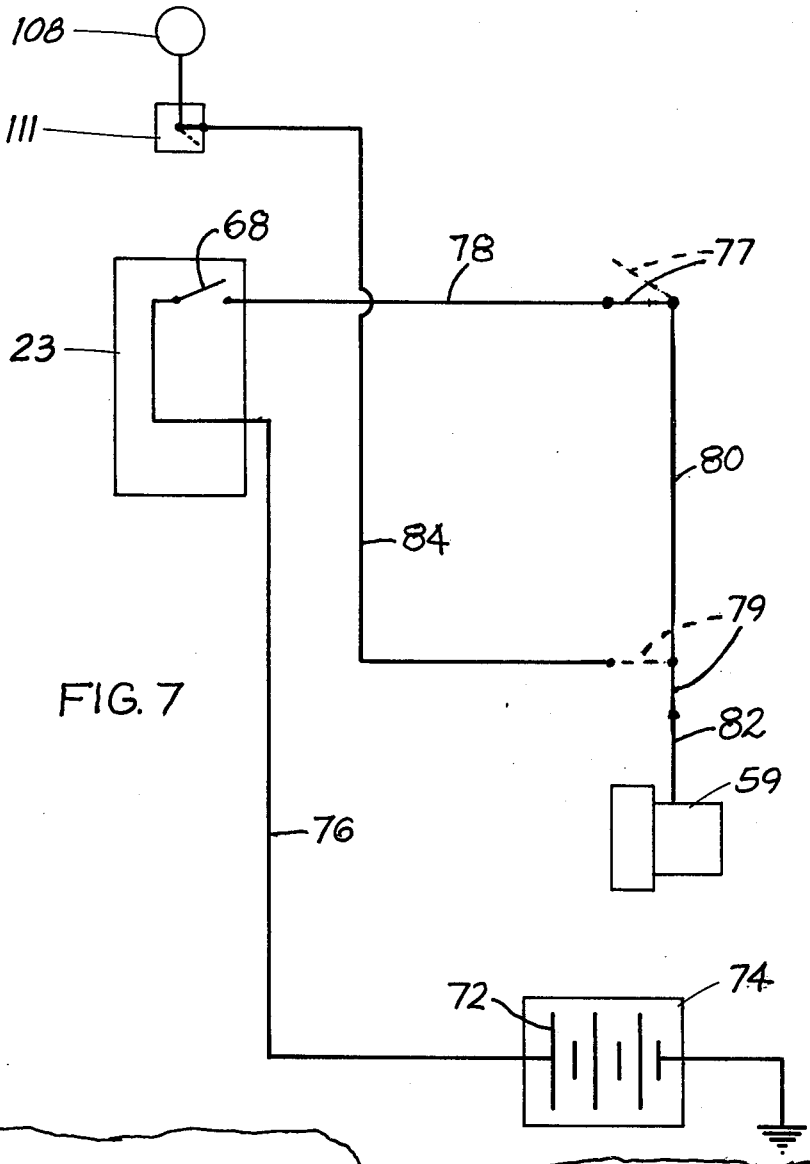
FIG. 7 is a simplified electrical schematic of the machine.
Figure 8:
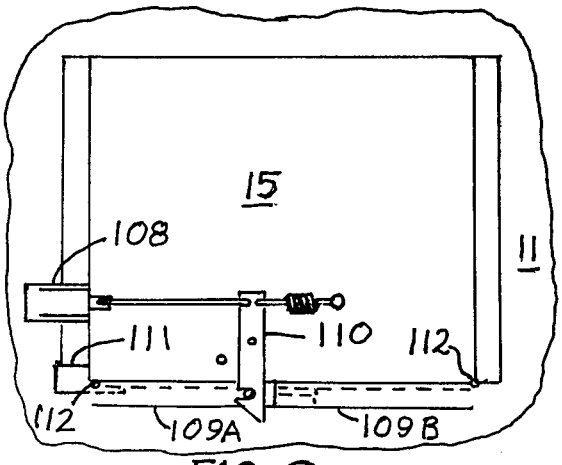
FIG. 8 is a rear elevational view of the display window chamber.

The magazine is initially filled with newspapers until the top of the uppermost newspaper is flush with the top of tab 70 so that upon insertion of the proper coin or coins into the coin slot 17, after the coin(s) passes through coin intake chute 21 into the command module 23, they close switch 68 which is connected electrically to motor 59 via conductor 78, normally closed pressure-sensitive switch 77, conductor 80, double-throw switch 79 and conductor 82 (as best seen in FIG. 7), so as to energize motor 59, which rotates shaft 69 and pinion 71 thereon clockwise as viewed in FIGS. 3 and 5, thus initiating downward movement of post 41. Normally closed pressure-sensitive switch 77 is on the upper surface of sloping end portion 75 of post 41 such that when the upper surface of sloping end portion 75 of post 41 passes the bottom of the uppermost newspaper in the magazine, that newspaper will slide downwardly over tab 70 and post end portion 75, opening switch 77 and breaking the circuit from the command module 23 to motor 59, thus halting downward movement of post 41 so that its upper extremity is substantially flush with the top of the then uppermost newspaper in the magazine and taking command module back to zero, opening switch 68. The first newspaper then slides downwardly into the discharge chute 29 and out through opening 27, where the purchaser can pick it up as it stops against lip 31, and tab 70 by reason of its rearward inclination effectively holds the second newspaper against downward movement until post 41 is again caused to move downwardly by insertion of the proper coins in coin slot 17.

Figure 9:
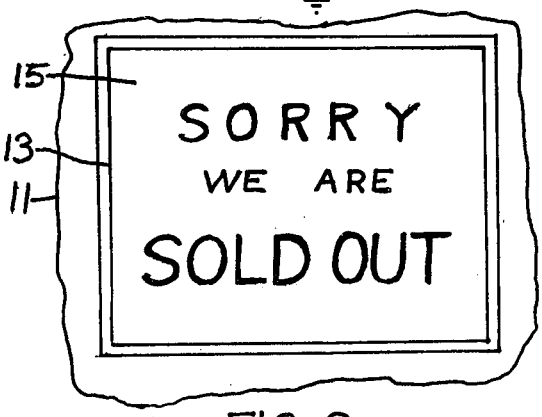
FIG. 9 is a fragmentary front elevation showing the display window without a newspaper, with its rear wall exposed.

This cycle will, of course, be repeated until the last newspaper resting on magazine bottom wall 39 passes over the top of post 41, which will by then have been lowered by motor 59 to a position wherein its sloping end portion 75 is flush with magazine bottom wall 39. Pressure responsive switch 79 is mounted in the bottom wall 39 of the magazine and is normally in the solid line position shown in FIG. 7, connecting conductors 80 and 82. When the last newspaper is discharged from the magazine as it passes over switch 79, the release of pressure on switch 79 causes it to throw to the broken line position shown in FIG. 7, which connects it via conductor 84 and normally closed switch 111 on display window box 15 with a solenoid 108 in the display window box such that upon insertion of a coin after the last paper has been discharged from the magazine, instead of energizing motor 59 to lower post 41, switch 79 energizes display solenoid 108, which releases spring actuated latch 110 permitting the drop doors 109 A and B which are hinged at 112 to the sides of the display window chamber 15 to open, whereby the display newspaper drops by gravity into the delivery chute to be picked up by the customer when it passes through delivery opening 27. As shown in FIG. 9, the rear wall of display chamber 15 bears the legend "Sorry we are SOLD OUT" or the equivalent to advise prospective customers of this fact and dissuade them from inserting coins in the machine. Display empty switch 111 adjacent the display window chamber is normally held closed by drop doors 109 A and B while they are closed, but opens when the doors 109 A and B opens to release a paper, de-energizing solenoid 108 and permitting its return to its non-energized condition in which it relatches doors 109 A and B, when the latter are manually closed.

To prevent newspapers near the bottom of the stack from jamming at the acute angle intersection between the post 41 and magazine sloping bottom wall 39 which would increase friction resisting downward movement of the post, a pair of upright bars 97 are mounted on opposite sides of posts 41 and are biased upwardly by springs 99 seated against a flange 101 on a bracket 103 depending from drive mechanism housing 43. Bars 97 are positioned with their rear surfaces approximately ¼ inch rearwardly of that of post 41 and they have a similarly sloping top member 105. Bars 97 are arranged to protrude approximately 4 inches above the bottom wall 39 at their full height and sloping top portion 75 of post 41 is provided with a pair of laterally projecting rods 107 adapted to engage the upper surfaces of top members 105 of bars 97 when post 41 approaches bottom wall 39, so as to cause bars 97 to move downwardly in unison thereafter with post 41 and not interfere with papers freed by downward movement of post 41 responsive to the insertion of the proper coins in coin slot 17 by purchasers. By virture of the projection of bars 97 rearwardly of post 41 jamming of newspapers between post 41 and bottom wall 39 is prevented, and at the same time bars 97 do not interfere with release of the newspapers by downward movement of post 41.

Operation of the machine is as follows: The machine is stocked with newspapers by opening cabinet door 11, placing the desired number of papers in the magazine on the sloping bottom wall 39 thereof behind post 41 so that the top of the top paper is flush with sloping end portion 75 of post 41, and a display paper is inserted in display window box 15 through the open top of chamber 15, after which cabinet door 11 is closed and locked.

When a purchaser inserts the proper change in coin slot 17, the change drops through chute 21 and into the command module 23 to close switch 68, energizing motor 59 which drives pinion 71 to move rack 73 and post 41 downwardly until the top newspaper slides across tab 70 and the sloping top portion 75 of post 41, depressing pressure-responsive switch 77 as it passes over and breaking the motor circuit, to stop downward movement of post 41 returning control module 23 to zero and opening switch 68 therein. Tab 70 positively separates the following newspaper from the released newspaper and positively holds the following newspaper against release until post 41 is again lowered as described above. The paper drops into discharge chute 29 and through discharge opening 27, where it is picked up by the purchaser when it stops against flange 31. This cycle is repeated, and when the level of the papers drops below the level of anti-jamming bars 97, horizontal rods 107 on post 41 sloping top member 75 engage the sloping top portions 105 of bars 97 to keep them at a lower level than the top of post 41, thus preventing interference with the discharge of papers as post 41 lowers to its bottom position wherein its top 75 is flush with sloping bottom wall 39 of the magazine. During the downward movement of anti-jamming bars 97, they keep the lower papers in the magazine away from the angular intersection between post 41 and magazine bottom wall 39 and prevent their jamming but at the same time do not interfere with discharge of newspapers as post 41 approaches its bottom position. When the lowermost newspaper is freed by post 41 and discharged into outlet chute 31, magazine empty switch 79 is depressed as the last paper slides over it, providing an electrical connection between the command module and solenoid 108 on display window box 15, so that when another purchaser inserts a coin into coin slot 17, display solenoid 108 is energized to release display drop doors 109 A and B, permitting the display paper to drop downwardly into the delivery chute for pick-up by the purchaser. The release of the paper from the display window exposes the legend "Sorry we are SOLD OUT" or the equivalent, thus warning later prospective purchasers against depositing coins in the machine. For de-energizing the display solenoid, when the paper drops out of the display window position, door 109 A opens the display empty switch 111, de-energizing the solenoid 108, after which the display window drop doors 109 A and B may be closed manually and latched by latch 110.

The details of the machine disclosed herein may be varied substantially without departing from the spirit of the invention and the exclusive use of such modifications as come within the scope of the appended claims is contemplated.

I claim:

1. A vending machine for flat articles such as newspapers comprising an enclosed cabinet having an inclined ramp therein defining the bottom wall of an article storage magazine, an inclined outlet chute substantially aligned with said ramp and having a discharge opening communicating with the exterior of said cabinet, an upright vertically movable post adjacent the lower end of said ramp, electromechanical power means for lowering said post to release individual articles from said ramp and permit them to slide onto said outlet chute, coin actuated means for energizing said power means, said power means including means responsive to movement of a released article across said post for de-energizing said power means and interrupting downward movement of said post after each article has passed from said ramp onto said chute, a display window in said cabinet, a chamber within said cabinet registering with said window for receiving a display article, and electromagnetic means energized responsive to the discharge of the last article from said storage magazine and to said coin-actuated means for releasing said display article upon insertion of coins into said coin actuated means, said power means comprising a source of electric power, an electric motor drivingly connected to said post, a first conductor connecting said power source and said coin actuated means, said coin actuated means including a normally open switch closeable responsive to insertion of proper coinage, said de-energizing means comprising a first normally-closed pressure-responsive switch in the upper end of said post openable responsive to the passage thereover of an article, a second conductor connecting said normally-open switch and said first normally-closed pressure-responsive switch, a second pressure-responsive switch in the bottom of said newspaper storage magazine, a third conductor connecting said first and second pressure-responsive switches, a fourth conductor connecting said second pressure-responsive switch and said motor, said second pressure-responsive switch normally connecting said third and fourth conductors, said display window chamber having a drop door and a solenoid normally permitting said drop door to be latched in closed position when de-energized and releasing said door when energized, a third normally-closed switch openable responsive to the discharge of a newspaper from said display window chamber, a fifth conductor connecting said second and third switches, said second pressure-responsive switch normally connecting said third and fourth conductors and being constructed to disconnect said third and fourth conductors and connect said third and fifth conductors upon release of the last article from said article storage magazine, whereby to cut out said motor and to energize said solenoid to release said drop door upon receipt by said coin actuated means of proper coinage and thereby permitting said drop door to open and discharge the article from said display window chamber, said third switch de-energizing said solenoid responsive to discharge of the article from said display window chamber.

2. A vending machine according to claim 1, wherein said power means comprises a rack on said vertically movable post and a pinion driven by said electric motor meshing with said rack.

3. A vending machine according to claim 1, wherein said chamber is shallow and has a rear wall substantially parallel to the plane of said display window and bearing a legend indicating that the machine is sold out, said display article when positioned within said chamber, obscures said legend and when released from said chamber, exposes said legend.

4. A vending machine according to claim 1, wherein the upper end surface of said post and said inclined ramp have substantially the same slope.

5. A vending machine for flat articles such as newspapers comprising an enclosed cabinet having an inclined ramp therein defining the bottom wall of an article storage magazine, an inclined outlet chute substantially aligned with said ramp and having a discharge opening communicating with the exterior of said cabinet, an upright vertically movable post adjacent the lower end of said ramp, electromechanical power means for lowering said post to release individual articles from said ramp and permit them to slide onto said outlet chute, coin actuated means for energizing said power means, said power means including means responsive to movement of a released article across said post for de-energizing said power means and interrupting downward movement of said post after each article has passed from said ramp onto said chute, the upper end surface of said post and said inclined ramp have substantially the same slope, and an upwardly and rearwardly extending tab at the intersection of the upper end surface and vertical rear surface of said post to provide positive separation between a released article and the article immediately beneath it.

6. A vending machine for flat articles such as newspapers comprising an enclosed cabinet having an inclined ramp therein defining the bottom wall of an article storage magazine, an inclined outlet chute substantially aligned with said ramp and having a discharge opening communicating with the exterior of said cabinet, an upright vertically movable post adjacent the lower end of said ramp, electromechanical power means for lowering said post to release individual articles from said ramp and permit them to slide onto said outlet chute, coin actuated means for energizing said power means, said power means including means responsive to movement of a released article across said post for de-energizing said power means and interrupting downward movement of said post after each article has passed from said ramp onto said chute, said storage magazine having transversely spaced upright side walls with outturned flanges along their forward margins, said post having rearwardly extending arms at its sides mounting at their rear ends anti-friction means engaging the rear surfaces of said flanges to resist forward bending forces applied to said post by articles stored in said storage magazines.

7. A vending machine for flat articles such as newspapers comprising an enclosed cabinet having an inclined ramp therein defining the bottom wall of an article storage magazine, an inclined outlet chute substanially aligned with said ramp and having a discharge opening communicating with the exterior of said cabinet, an upright vertically movable post adjacent the lower end and at an acute angle to said ramp, electromechanical power means for lowering said post to release individual articles from said ramp and permit them to slide onto said outlet chute, coin actuated means for energizing said power means, said power means including means responsive to movement of a released article across said post for de-energizing said power means and interrupting downward movement of said post after each article has passed from said ramp onto said chute, the upper end surface of said post and said inclined ramp have substantially the same slope, and means for preventing jamming of articles in the acute angle intersection of said post and said ramp.

8. A vending machine according to claim 7, wherein said means for preventing jamming comprises at least one vertically movable bar having its rear surface slightly rearwardly of the rear surface of said post and being resiliently biased upwardly independently of vertical movment of said post, said post and said bar each having a member disposed below a portion of said post whereby to prevent said bar from protruding upwardly to a higher level than said post and thus avoiding interference by said bar with discharge of articles from said storage magazine responsive to downward movements of said post.

9. A vending machine according to claim 8, wherein said bar at its full height extends upwardly from said ramp a substantially shorter distance than the maximum height of said post.

10. A vending machine according to claim 9, wherein there are a pair of said bars disposed respectively on opposite sides of said post.

11. A vending machine according to claim 10, wherein said bars have sloping upper surfaces of substantially the same inclination as the top surface of said posts and of said ramp, and said post including members overlying said bar top surfaces whereby to cause said bars to be lowered in unison with said post after said post has been lowered to the maximum height of said bars.

* * * * *